US006290372B1

(12) United States Patent
Mack

(10) Patent No.: US 6,290,372 B1
(45) Date of Patent: Sep. 18, 2001

(54) SPIRAL CHRISTMAS LIGHT HANGER

(76) Inventor: Chieko S. Mack, P.O. Box 534, Aberdeen, WA (US) 98520

( * ) Notice: Subject to any disclaimer, the term of this patent is extended or adjusted under 35 U.S.C. 154(b) by 0 days.

(21) Appl. No.: 09/559,866

(22) Filed: Apr. 26, 2000

(51) Int. Cl.[7] ..... F21V 21/00
(52) U.S. Cl. ..... 362/249; 362/396; 248/71
(58) Field of Search ..... 174/163 R; 248/65, 248/71, 74.1, 74.2; 362/249, 391, 396

(56) References Cited

U.S. PATENT DOCUMENTS

| | | | |
|---|---|---|---|
| 90,998 | 6/1869 | Heureuse . | |
| 358,268 | 2/1887 | Hoffstatter . | |
| 412,593 | 10/1889 | Brinkerhoff . | |
| 729,770 | 6/1903 | Jenkins . | |
| 1,097,443 | 5/1914 | Kalat . | |
| 3,210,722 | 10/1965 | Johns . | |
| 4,714,219 | 12/1987 | Mayse . | |
| 5,624,180 | 4/1997 | Lanning . | |
| 5,669,709 * | 9/1997 | Adams | 362/396 |
| 5,813,751 | 9/1998 | Shaffer . | |
| 6,070,837 * | 6/2000 | Bond | 248/71 |

* cited by examiner

*Primary Examiner*—Stephen Husar
(74) *Attorney, Agent, or Firm*—Brian J. Coyne

(57) ABSTRACT

A Christmas light string holder for use on interior and exterior surfaces of buildings. The holder comprises a flexible, resilient, helical wire, a fastener such as a nail or screw and, optionally, a convex cap with a hollow recess for dressing the head of the nail. To mount a light string on a surface, a holder is attached at each of several spaced apart locations on the surface, and the light string is wedged between, and retained by, adjacent turns of the helical wires. The light string is easily disattached from the holders by spreading apart the adjacent turns long enough to lift away the light string. The holders can remain in place year-round if desired, and can be used for mounting other objects to the same surface.

14 Claims, 7 Drawing Sheets

SPIRAL CHRISTMAS LIGHT HANGER

CROSS REFERENCE TO RELATED APPLICATIONS

Not applicable.

STATEMENT REGARDING FEDERALLY APPROVED RESEARCH OR DEVELOPMENT

Not applicable.

BACKGROUND OF THE INVENTION

1. Field of the Invention

This invention relates to Christmas light string mounting devices, and helically coiled spring connectors of the type that serve as a quickly attachable and detachable solderless electrical connector.

2. Background Art

Various brackets and other structures have been devised for attaching Christmas light strings to interior and exterior surfaces of buildings. Exemplary of these are the Christmas light hangers of Mayse, U.S. Pat. No. 4,714,219; the light string mounting bracket of Lanning, U.S. Pat. No. 5,624,180; and the device for permanent installation of Christmas lighting of Shaffer, U.S. Pat. No. 5,813,751. A disadvantage of such devices is that, once the Christmas season is past, they are not readily adaptable for hanging or supporting objects other than Christmas light strings, such as Halloween decorations, mobiles and other types of hanging sculptures and decorations. What is desired, therefore, is a device, mountable on a wall surface and capable of supporting a Christmas light string, by which various kinds of objects can be supported directly (e.g., bunting) or suspended by a cord or string from the wall by attaching the cord or string to the device; and, further, that the device be configured such that the cord, string (including, for instance, a Christmas light string) or other object can be quickly and easily attached and disattached from the device.

I have found that these needs are well served by a helical coil, comprised of flexible, resilient wire, in combination with an appropriate fastener, such as a nail or screw, for attaching the coil to a wall surface. A number of these coils, spaced apart along a wall surface and fastened thereto, can readily support a Christmas light string that is wedged in between, and retained by, adjacent turns within each of the coils. Removal of the light string is accomplished simply by separating the adjacent turns of each coil enough to permit withdrawal of the light string. Similarly, a cord or string for suspending an object from the coil is easily attached to, and disattached from, such a wall-mounted coil in the same manner.

Helical coils have been used previously for securing cords, wires, and the like. Brinkerhoff, U.S. Pat. No. 412,583, disclosed a picture nail comprising a helical coil of wire or other suitable material that surrounded the shank of a nail closely at its ends and was of larger diameter between said ends. A cord for suspending a picture frame could be retained between adjacent turns of the coil. Due to the presence of the coil, the nail could only be driven partially into a wall surface. Driving the nail into a wall surface tended to compress the coil, which may be acceptable when hanging a picture frame but, for hanging a Christmas light string, is deemed undesirable inasmuch as electric wires in the light string might be damaged by excessive compressive force between adjacent turns of the coil. Moreover, the presence of the portion of the nail that extended away from the wall surface interfered with separation of adjacent turns when removing the cord.

Johns, U.S. Pat. No. 3,210,722, disclosed a helical spring type connector, comprising an upper portion of approximately polygonal convolutions and a lower portion formed of circular convolutions of decreasing diameters, the latter convolutions being adapted for insertion in a recess in a plate or foundation. An electrical conductor could be clamped between adjacent convolutions of the upper portion. No separate fastener, such as a nail or screw, was provided or required, but a recess was required in the surface to which the fastener was to be attached. Having to drill a series of such recesses on interior or exterior wall surfaces would be laborious and likely to mar said surfaces, thereby making Johns' connector unsuitable for the intended range of applications of the instant invention.

SUMMARY OF THE INVENTION

According to the present invention, there is provided a holder for mounting a Christmas light string on an exterior or interior surface of a building or structure. The holder includes a nail having a first, reduced end, and a second, opposite end that terminates in an enlarged head; and a flexible, resilient wire having a first end that is attached to the nail. The wire comprises a plurality of helical turns of progressively increasing radius with increasing axial distance from said nail head. To attach the holder to a surface, the reduced end of the nail is placed on the surface, force is applied to radially displace the wire and thereby expose the nail head long enough to permit hammering the nail into the surface. Thereafter, the force is terminated and the wire, due to its resilience, springs back into a position overlying the nail head. Accordingly, to mount a Christmas light string, holders of the type described are attached at desired intervals to said surface, and portions of the Christmas light string are wedged between, and retained by, adjacent helical turns of each of the holders. Removal of the Christmas light string is just as easy: the adjacent turns of each holder wherein the light string is wedged are separated and the light string lifted away. Optionally, the holder further includes a cap with a hollow recess for placement on the nail head to improve its appearance. The holder may also be used for attaching other types of objects to a wall surface, either by inserting the object itself between adjacent turns of wire or by suspending the object from a cord or string that is wedged between adjacent turns of wire.

Further according to the invention, a method is provided for attaching a Christmas light string to a surface. The method includes the steps of grasping a nail having a first, reduced end and a second, opposite end that terminates in an enlarged nail head; inserting the nail, reduced end first, all the way up to the nail head, through a first, smallest radius turn of a flexible, resilient, helical wire that comprises a plurality of progressively increasing radius with increasing axial extent; placing the reduced end of the nail on the surface; grasping and displacing the helical wire to expose the nail head; hammering the nail into the surface; releasing the helical wire to permit it to resume a position overlying and extending axially away from the nail head; inserting a selected portion of a Christmas light string between adjacent turns of the helical wire, whereby that portion is retained by the adjacent turns; and, for each successive portion of the light string, repeating the foregoing steps. As an alternative way to fasten the helical wires to the surface, screws can be substituted for nails and the screws driven into the surface with a screwdriver in lieu of hammering nails into the surface. For exterior applications, the fasteners should be rust resistant—galvanized or stainless steel, for instance.

BRIEF DESCRIPTION OF THE DRAWINGS

Like reference numerals indicate corresponding parts throughout the several figures. The term "radial direction" will be understood to refer to a direction that is radial with respect to axis A—A, as shown, for example, by arrow 60 in FIG. 6.

DETAILED DESCRIPTION OF THE PREFERRED EMBODIMENT

Figure 1:
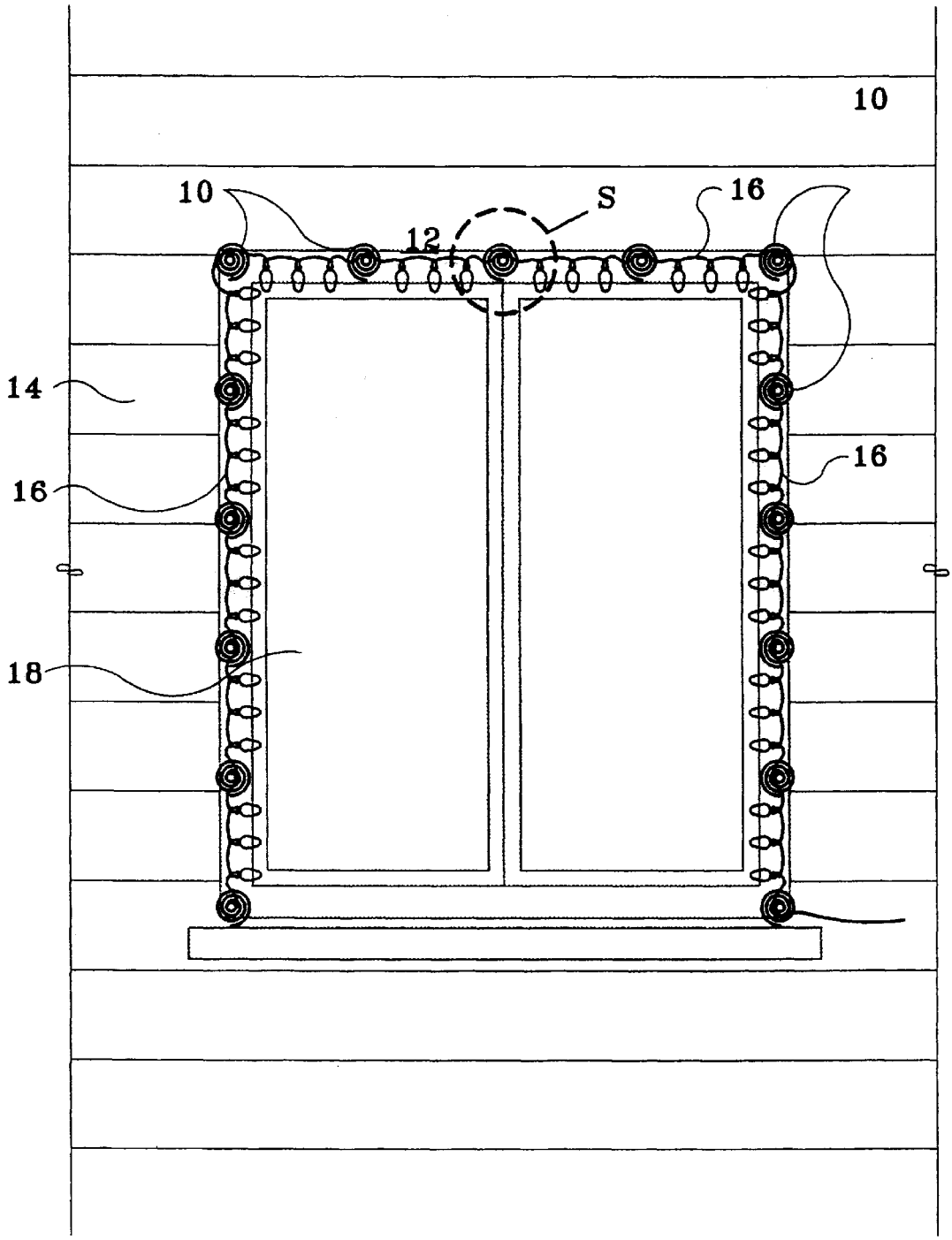
FIG. 1 is an elevational view of an exterior portion of a building, including a window that has been partially surrounded by a Christmas light string attached to the building by a plurality of my holders.
Figure 2:
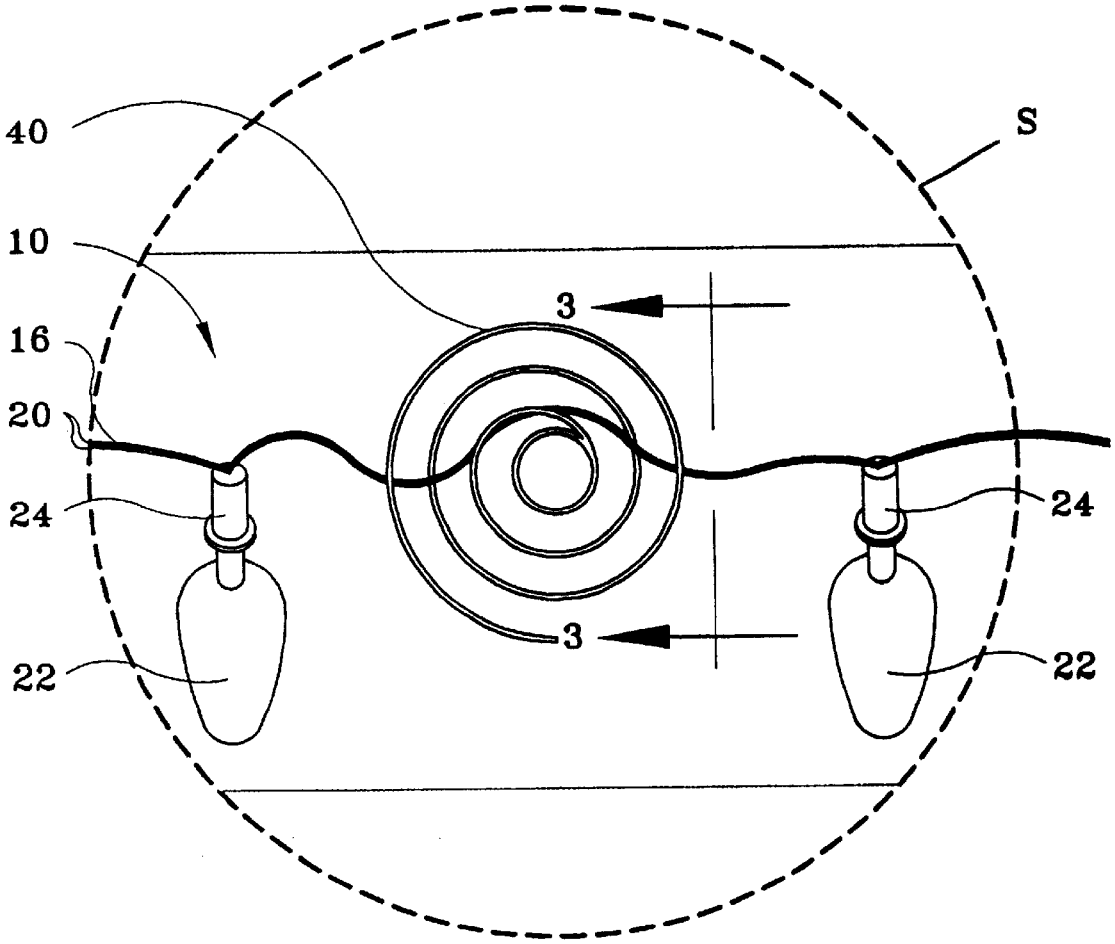
FIG. 2 is an enlarged view of circular portion S of FIG. 1.
Figure 3:
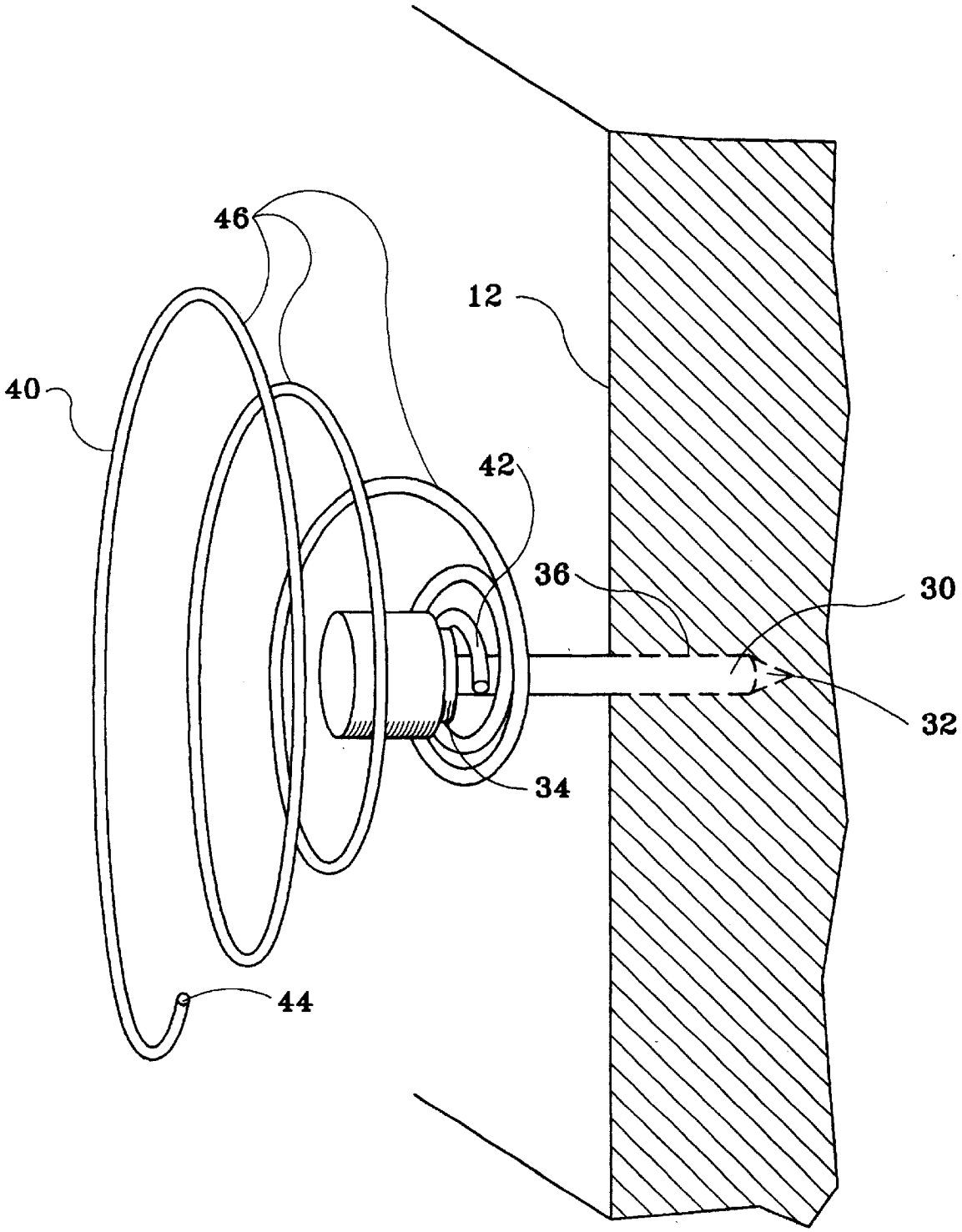
FIG. 3 is a cross-sectional view thereof taken along line 3—3 of FIG. 2, with the light string removed for clarity.
Figure 4:
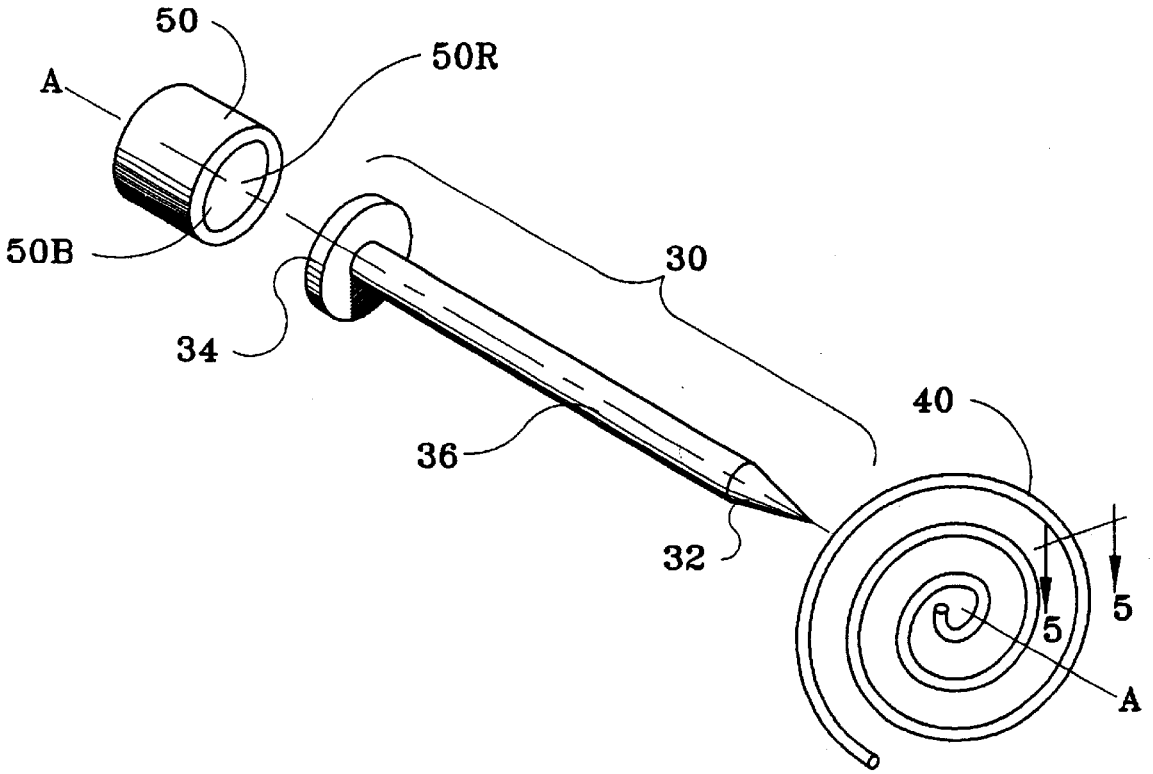
FIG. 4 is an expanded, perspective view of my holder, including the optional cap thereof.

Referring to FIG. 1, several of my holders 10 are shown attached to an exterior surface 12 of a building 14, supporting in place a Christmas light string 16 that partially surrounds a window 18. The light string 16, which forms no part of the instant invention, is of conventional construction, and includes a pair of insulated, conducting wires 20 and, spaced apart along said wires 20, a plurality of light bulbs 22 inserted in light bulb sockets 24 that are connected in series or parallel to the conducting wires 20. As shown more clearly in FIGS. 2, 3, 4 and 6, each holder 10 comprises a nail 30, a helical coil of flexible, resilient wire 40, and, optionally, a cap 50. The nail 30 has a first, reduced end 32 (i.e., the point of the nail), a second, opposite end that terminates in an enlarged nail head 34, and an axially-elongated shank 36 intermediate the first end 32 and the second end 34.

The helical wire 40 extends through a plurality of helical turns 46 from a first end 42 to an opposite, second end 44. The number of turns is preferably in the range of three to six. In a preferred embodiment, the first end 42 is formed into a loop or eye having a first, smallest diameter that is just slightly larger than the width of the nail shank 36 and smaller than the width of the nail head 34, such that, the nail 30 can be inserted, reduced end 32 first, through the eye all the way up to the nail head 34, and no further. Alternatively, the first end 42 can be permanently attached to the nail shank 36 adjacent to the nail head 34, as by brazing, soldering, welding and such other methods as are known to persons of ordinary skill in the art. With the helical wire 40 so attached to the nail 30, the wire 40 extends axially away from the nail head 34, and the radius of each successive turn 42 increases with increasing axial extent away from the nail head 34.

Figure 5:
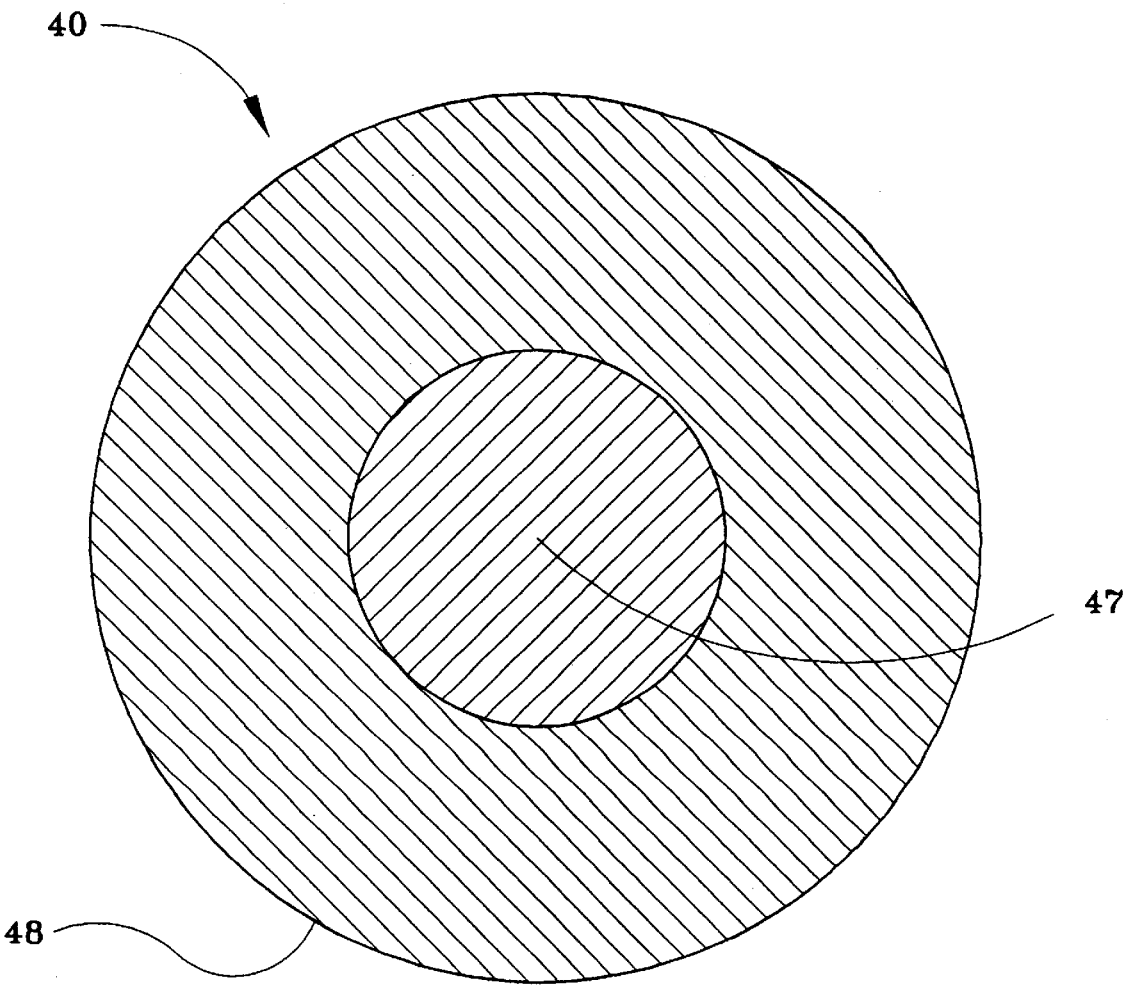
FIG. 5 is a cross-sectional view of the helical wire thereof taken along line 5—5 of FIG. 4.

To improve its appearance, my holder can further include a cap 50, preferably made of rubber. Referring to FIG. 5, the cap 50 is a convex dome with a flat bottom 50B. The bottom 50B has a hollow recess 50R adapted to receive, partially surround, and closely engage the nail head 34.

Figure 6:
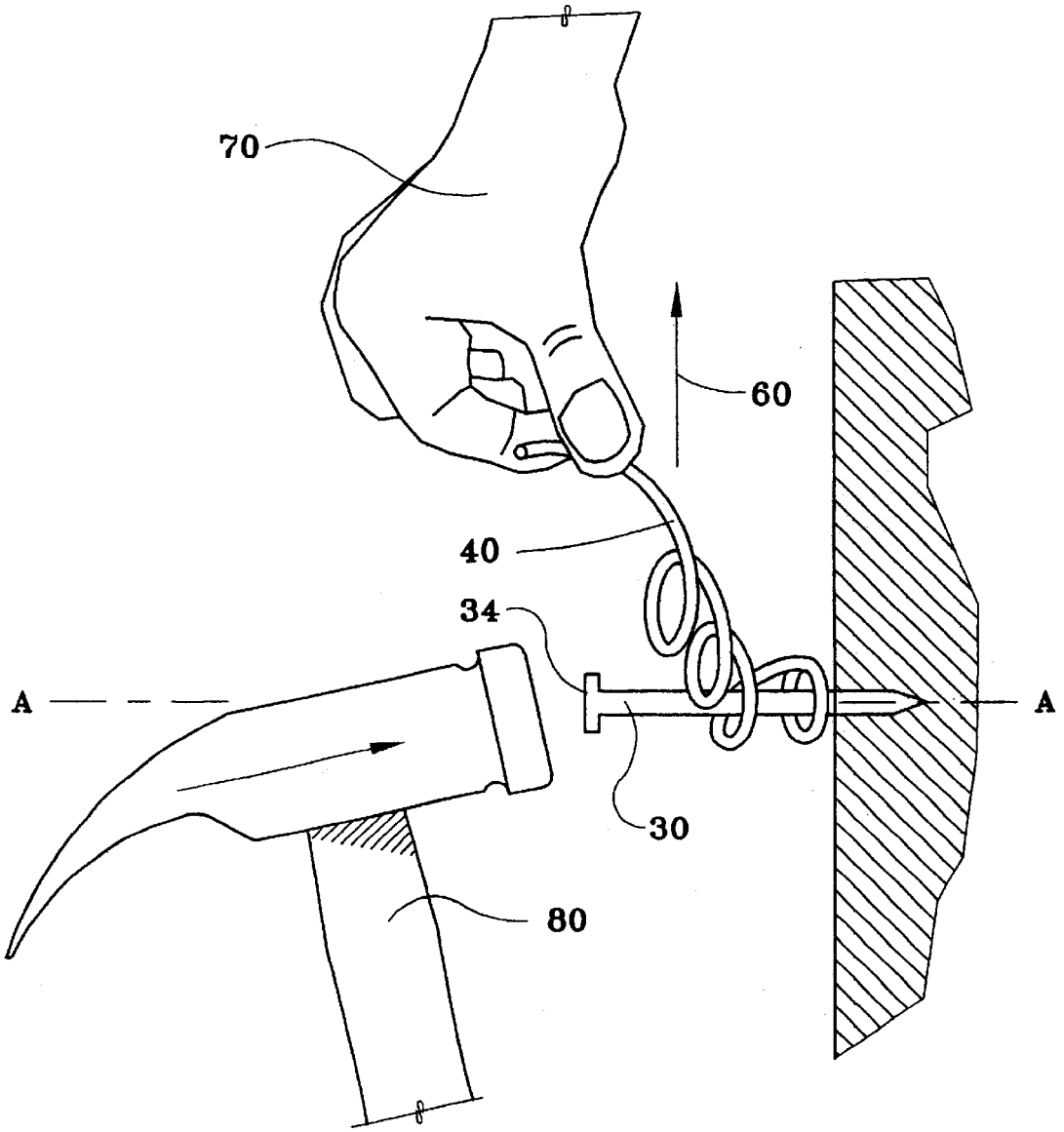
FIG. 6 is a fragmentary, cross-sectional view of a wall, showing the nail head of my holder being exposed by displacement of the helical wire away from the nail in order to permit hammering the nail into the wall.
Figure 7:
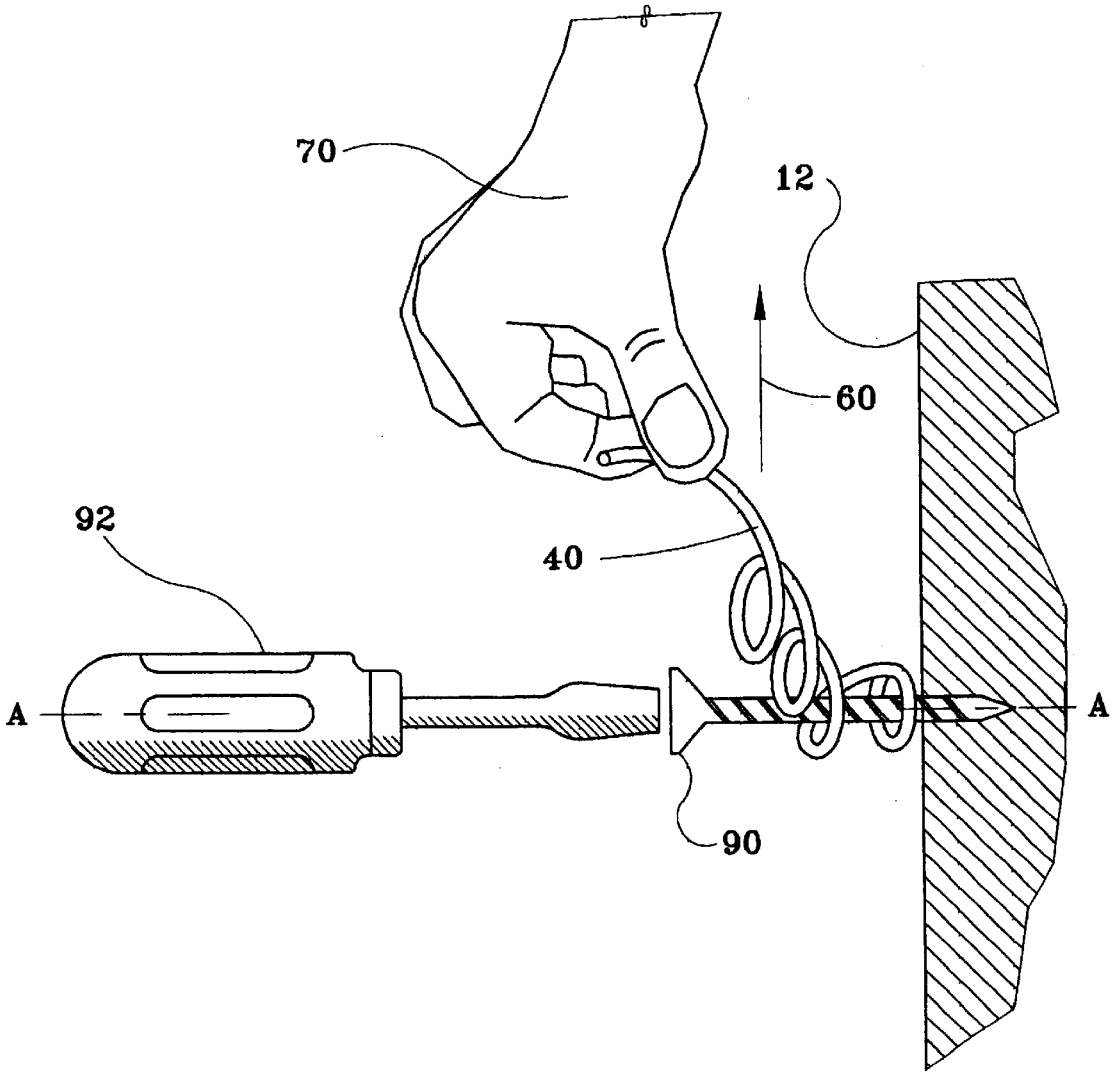
FIG. 7 is a fragmentary, cross-sectional view of a wall, showing installation of an alternative embodiment of my holder on the surface of the wall.

In use, the nail 30 is attached to the helical wire 40, as, for example, by inserting the nail 30, reduced end 32 first, through a first, smallest radius turn of the wire 40 at a first end 42 thereof, all the way until the nail head 34 is adjacent said first end 42. Referring now to FIG. 6, with the wire 40 attached, the reduced end 32 of the nail 30 is placed against a surface 12 to which it is desired to attach a selected segment of light string 16, the wire 40 is displaced radially away from the nail 30 to expose the nail head 34 (by hand 70 or with the aid of a tool, such as pliers—not shown), the nail 30 is hammered into the surface 12 with a hammer 80 until the nail head is adjacent said surface 12, and the wire 40 is released to resume a position overlying, and extending axially away from, the nail head 34. The cap 50 is then pushed onto the nail head 34. This sequence of steps is repeated at spaced apart locations on the surface 12 with as many additional holders 10 as may be needed to attach additional segments of the light string 16 to the surface 12. In an alternative embodiment of the holder 10 and of the method of use of the holder 10, a screw 90 may be substituted for the nail 30, and a screw driver 92 substituted for the nail 30, as depicted in FIG. 7.

The wire 40 may be made of any material of suitable flexibility, resiliency and durability, such as spring steel or plastic. If the wire 40 is made of a material that is an electric conductor, such as spring steel 47, the wire 40 should be coated with electric insulation 48, as depicted in FIG. 5, to minimize electric shock hazard. Thus, it will be appreciated that modifications can be made to the exact form of the present invention without departing from the scope thereof. It is accordingly intended that the disclosure be taken as illustrative only and not limiting in scope, and that the scope of the invention be defined by the following claims.

I claim:

1. A Christmas light string holder, comprising:

a. a nail having a first, reduced end and a second, opposite end that terminates in an enlarged head; and b. a flexible, resilient wire having a first end attached to the nail, said wire comprising a plurality of helical turns of progressively increasing radius with increasing axial distance from said nail head;

wherein, said turns are resiliently deformable under radially-directed force to expose said nail head long enough to permit hammering of the nail, and thereafter, when said force is terminated, to return to a helical form substantially coaxial with said nail and overlying said nail head.

2. The holder of claim 1, wherein the wire includes a first turn having a radius just slightly larger than the radius of the second end of the nail adjacent to said nail head and smaller than the radius of the nail head, thereby permitting insertion of said nail through said first turn of the wire, reduced end first, up to said nail head and no further.

3. The holder of claim 1, further comprising a concave disk cap, said cap having a hollow recess adapted for receiving said nail head in close fitting engagement, whereby, after said nail has been hammered into a surface that is to be adorned with a string of Christmas lights, said nail head may be dressed by application of said cap to said nail head.

4. The holder of claim 3, wherein said cap is made of rubber.

5. The holder of claim 1, 2, 3, or 4, wherein said wire is made of spring steel.

6. The holder of claim 5, wherein said wire has an electric insulation coating.

7. The holder of claim 1, 2, 3, or 4, wherein said wire is made of resilient plastic.

8. A method for hanging a Christmas light string on a surface, comprising the steps of:

a. grasping a fastener having a first, reduced end and a second, opposite end that terminates in an enlarged head;

b. inserting said fastener, reduced end first and all the way up to said head, through a first, smallest radius, turn of a resilient, helical wire, said wire comprising a plurality of turns of progressively increasing radius and progressively increasing axial extent, whereby said helical wire overlies and extends axially away from said nail head;

c. placing said reduced end of said fastener on said surface;

d. grasping and displacing said helical wire to expose said head;

e. inserting said fastener into said surface;

f. releasing said helical wire to permit it to again overlie and extend axially away from said head; and g. inserting a Christmas light string between adjacent turns of said helical wire, whereby said string is retained by said adjacent turns.

9. The method of claim 8, wherein the fastener is a nail.

10. The method of claim 8, wherein the fastener is a screw.

11. The method of claims 8, 9 or 10, further comprising the step of:

h. dressing said head by installing thereon a rubber disk cap having a hollow recess adapted to receive said head.

12. A Christmas light string holder, comprising:

a. a screw having a first, reduced end and a second, opposite end that terminates in an enlarged head; and b. a flexible, resilient wire having a first end attached to the screw, said wire comprising a plurality of helical turns of progressively increasing radius with progressively increasing axial distance from said screw head;

wherein, said turns are resiliently deformable under a radially-directed force to expose said screw head long enough to permit driving the screw with a screwdriver, and thereafter, when said force is terminated, to return to a helical configuration substantially coaxial with said screw and overlying said screw head.

13. The holder of claim 12, wherein the wire includes a first turn having a radius just slightly larger than the radius of the second end of the screw adjacent to said screw head and smaller than the radius of the screw head, thereby permitting insertion of said screw through said first turn of the wire, reduced end first, up to said screw head and no further.

14. The holder of claim 12, further comprising a convex disk cap, said cap having a hollow recess adapted for receiving and partially surrounding said screw head in close fitting engagement in order to improve the appearance of the holder.

* * * * *